United States Patent [19]

McCurry

[11] Patent Number: 4,574,531

[45] Date of Patent: Mar. 11, 1986

[54] SELF CORRECTING BELT TRACKING MECHANISM

[75] Inventor: Ronald C. McCurry, Seneca, S.C.

[73] Assignee: The Singer Company, Stamford, Conn.

[21] Appl. No.: 727,943

[22] Filed: Apr. 26, 1985

[51] Int. Cl.[4] ..... B24B 23/06; B24B 21/18

[52] U.S. Cl. ..... 51/170 EB; 51/135 BT

[58] Field of Search ..... 51/170 EB, 170 R, 135 BT, 51/135 R, 142, 148

[56] References Cited

U.S. PATENT DOCUMENTS

| | | | |
|---|---|---|---|
| 3,094,819 | 6/1963 | Murschel | 51/170 EB |
| 3,665,650 | 5/1972 | Przygocki | 51/135 BT |
| 3,971,166 | 7/1976 | Habeck et al. | 51/135 BT |
| 4,177,609 | 12/1979 | Rameckers et al. | 51/170 EB |

*Primary Examiner*—Roscoe V. Parker

*Attorney, Agent, or Firm*—Robert E. Smith; Edward L. Bell

[57] ABSTRACT

A self correcting belt tracking mechanism is disclosed for a portable belt sander having an idler belt roller arranged with its axis movable into and out of co-planer relation with that of a driven belt roller, and springs acting in opposition to each other to resist such idler roller axis movement.

4 Claims, 4 Drawing Figures

SELF CORRECTING BELT TRACKING MECHANISM

BACKGROUND OF THE INVENTION

1. Field of the Invention

This invention relates to portable electric power tools employing an endless work engaging belt such as a portable electric belt sander and, more particularly, to a novel and improved construction for influencing an endless sanding belt or the like to track substantially centrally on the belt supporting and driving rollers.

2. Description of the Prior Art

Most belt tracking mechanisms for commercially available portable belt sanders have employed a support for the belt idler roller which sustains the idler roller axis in the same plane as the axis of the drive roller but provides a pivotal support for the idler axis perpendicular to the common plane so that the idler axis may be swung out of parallelism with the axis of the drive roller. Self correcting means, where present in belt tracking mechanisms of this type, require edge contact with the abrasive belt by feed-back linkages which are wear prone and complicated mechanisms. The Murschel U.S. Pat. No. 3,094,819, June 25, 1963, and that of Rameckers et al U.S. Pat. No. 4,177,609, Dec. 11, 1979, are representative of such conventional belt centering constructions for portable belt sanders.

In abrading machinery not of a portable nature, tracking of an abrasive coated belt has been controlled by providing a support for a belt idler roller in a plane parallel to the axis of the drive roller but providing a pivotal support for the idler roller perpendicular to the plane containing the idler roller axis and about which the idler roller axis may be turned to impart a twist in the belt. The Przgocki U.S. Pat. No. 3,665,650, May 30, 1972, and that of Habeck et al U.S. Pat. No. 3,971,166, July 27, 1976, are representative of such emplaced abrading or sanding machinery. No portable belt sanders are known showing this type of belt tracking mechanism with self adjusting capability. The patented emplaced sanding machinery referenced above disclose complicated and space consuming belt sensing servomechanisms for self correcting belt centering, which mechanisms are ill adapted for use in portable belt sanders.

SUMMARY OF THE INVENTION

It is an object of this invention to provide a self correcting belt tracking mechanism for a portable electric belt sander which is simple and compact in construction and cost effective. It is also an object of this invention to provide a belt tracking mechanism of the above description which is not only operator adjustable to center a sanding belt relatively to the belt supporting rollers, but which is self correcting without requiring that any part of the mechanism be in wear prone edge contact with the abrasive belt.

The above as well as other objects and advantageous of this invention are provided by a portable electric belt sander construction in which a driven belt roller sustained on a fixed axis in the frame of the sander is complimented by an idler roller carried by a yoke assembly which is slidably journaled in the sander frame on an axis perpendicular to the driven shaft axis.

A main spring serving as both a compression spring and a torsion spring is arranged to act in compression between the sander frame and the yoke to apply tension to a belt entrained on the rollers. Radially extending extremities of the main spring engage respectively the sander frame and the idler roller yoke to impart torque in one direction to the yoke about the axis on which the yoke assembly is journaled in the frame. A second spring is provided stressed in tension between the yoke and the sander frame and arranged to act in opposition to the torsion inparting extremities of the main spring. Preferably an operator influenced means is provided for regulating the force exerted by the second spring so as to adjust the angular position of the idler roller axis.

DESCRIPTION OF THE DRAWINGS

With the above and additional objects and advantages in view as will hereinafter appear, this invention will be described with reference to a preferred embodiment illustrated in the accompanying drawings in which.

DETAILED DESCRIPTION OF THE INVENTION

Figure 1:
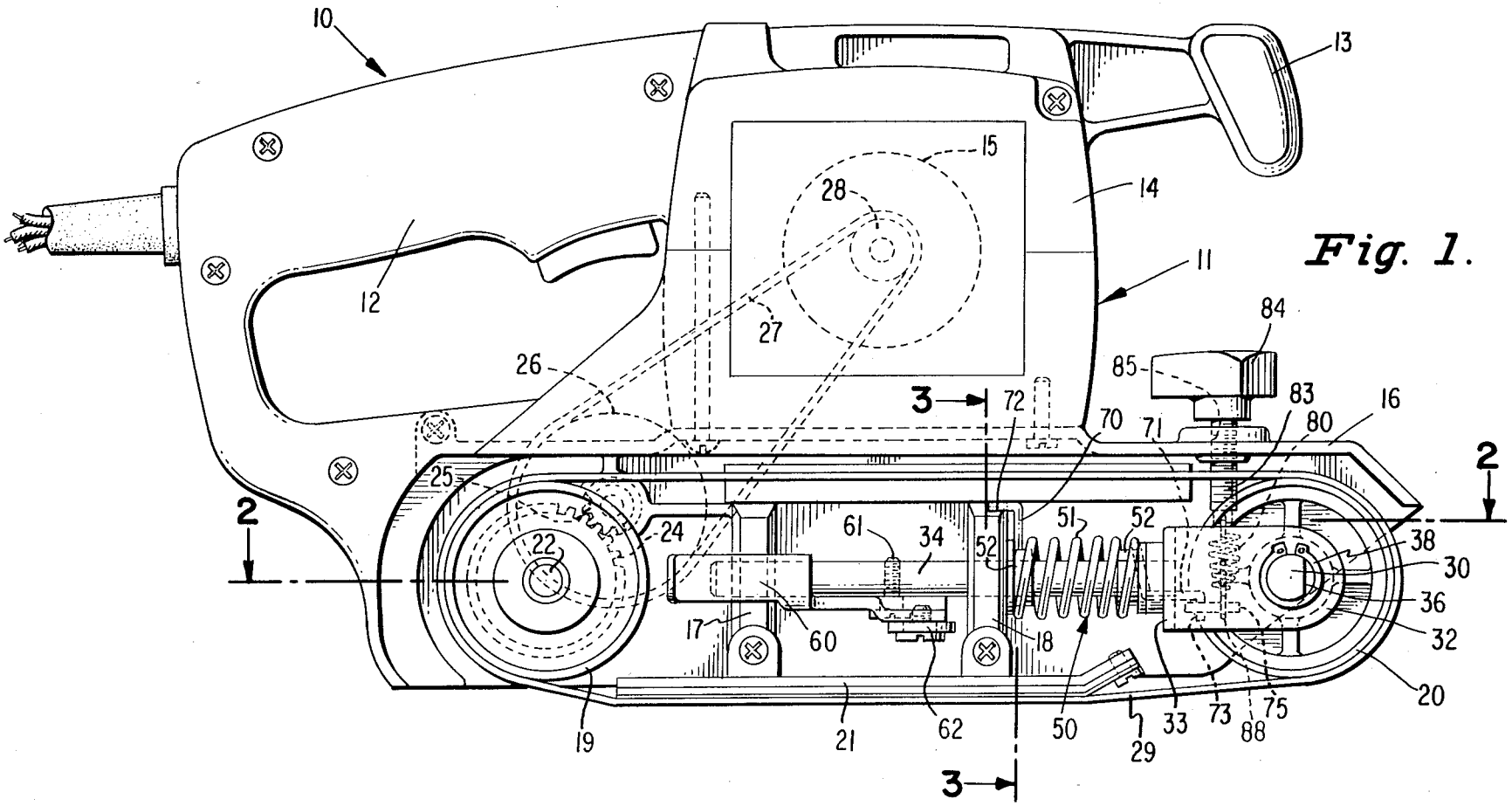
FIG. 1 is a side elevational view of a portable electric belt sander having this invention applied thereto.

FIG. 1 best illustrates the general construction of a portable electric belt sander 10 to which this invention is applied. The frame of the sander, indicated generally at 11, may include hand grips 12 and 13, a housing 14 for an electric motor 15, and a bottom portion 16 with transverse webs 17 and 18 supporting a slightly crowned driven belt roller 19, a slightly crowned idler belt roller 20, and a wear plate 21.

The driven roller 19 is fast on a shaft 22 journaled in a bearing boss 23 in the bottom support 16 of the frame. A gear 24 on the shaft 22 may be driven by the electric motor 15 as, for instance, by a pinion 25 journaled in the frame 16 meshing with gear 24 and associated with a belt pulley 26 engaging a belt 27 from a motor pulley 28. It will be understood that the driven roller 19 imparts motion to an endless sanding belt 29 accommodated on the rollers 19 and 20.

The idler roller 20 is freely journaled on an axle 30 sustained between the spaced arms 31–32 of a bifurcate yoke 33 staked fast to a cylindrical shaft 34. A clearance hole 35 in one yoke arm 31 accommodates one extremity of the axle, while a non-circular portion 36 at the opposite extremity of the axle 30 extends through a similarly shaped non-circular aperture 37 in the other yoke arm 32 and the axle is retained therein by a spring clip 38.

The bifurcated yoke 33 and cylindrical shaft 34 thus provide a yoke assembly which is supported for endwise sliding movement in a direction perpendicular to the axis of the driven roller shaft 22 by aligned cylindrical bearing bores 40 and 41 formed in frame webs 17 and 18, respectively, of the bottom frame portion 16. The bearing bores 40 and 41 also accommodate turning movement of the shaft 34, and with it, turning movement also of the idler roller 20 about the axis of the shaft 34.

Figure 2:
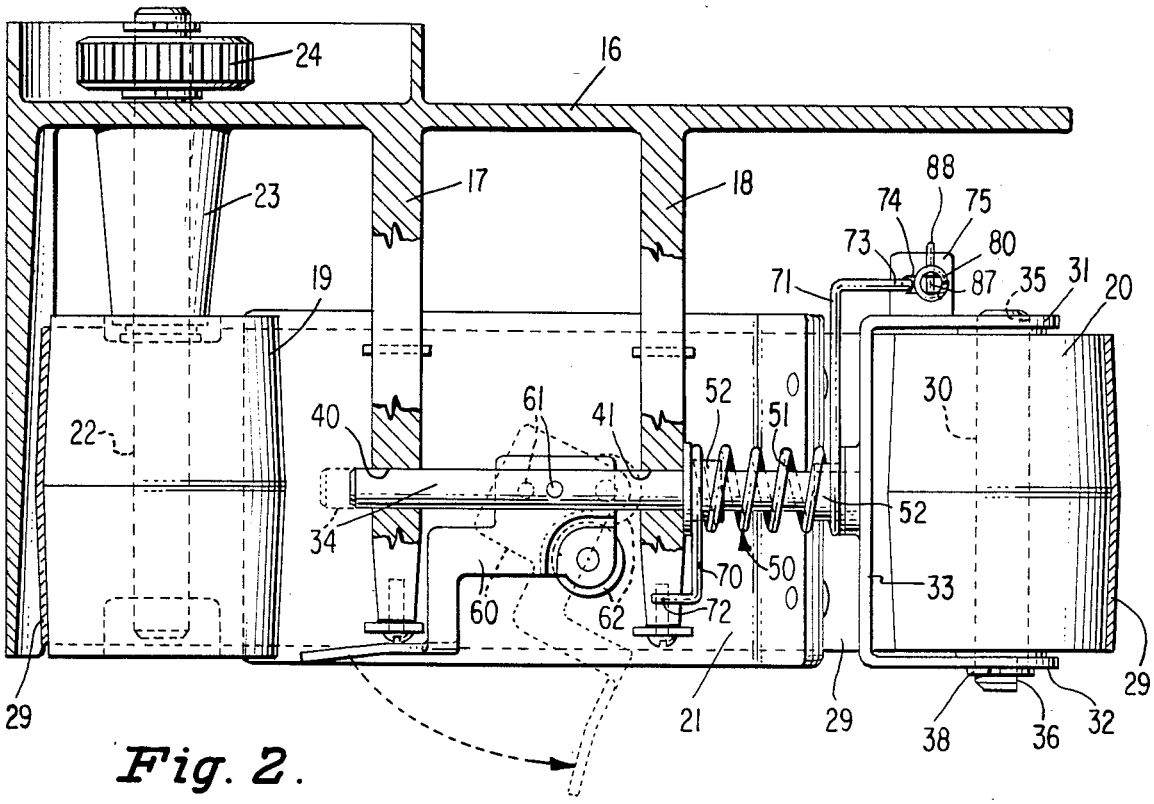
FIG. 2 is a horizontal cross sectional view taken substantially along line 2—2 of FIG. 1.

For urging the idler roller 20 in a direction away from the driven roller so that tension may be applied to a sanding belt accommodated on the rollers, a main spring indicated generally at 50 is provided. The spring 50 is formed with a portion 51 having continuous coils somewhat larger in internal diameter than the cylindrical shaft 34. As shown in FIGS. 1 and 2, the coiled portion 51 of main spring 50 is arranged on the cylindrical shaft 34 and between the frame web 18 and the idler roller yoke 33 with the spring coils arranged in compression biasing the idler roller away from the driven roller. Shouldered washers 52 may be interposed between the spring coils and the shaft 34 to evenly space the coils from the shaft with the flanged washer heads interposed between the spring coils 51 and the frame web 18 and yoke 33.

For removing belt tension, as for belt removal and replacement, a lever 60 is pivoted on a shouldered screw 61 threaded into the cylindrical shaft at a point between the frame webs 17 and 18. a roller 62 carried on the lever 60 can be brought into engagement with the frame web 18 opposite the spring 50 so that, when the lever is shifted into the dotted line position shown in FIG. 2, the idler roller will be retracted to the degree indicated by the dotted line position of the cylindrical shaft 34 in FIG. 2.

Figure 3:
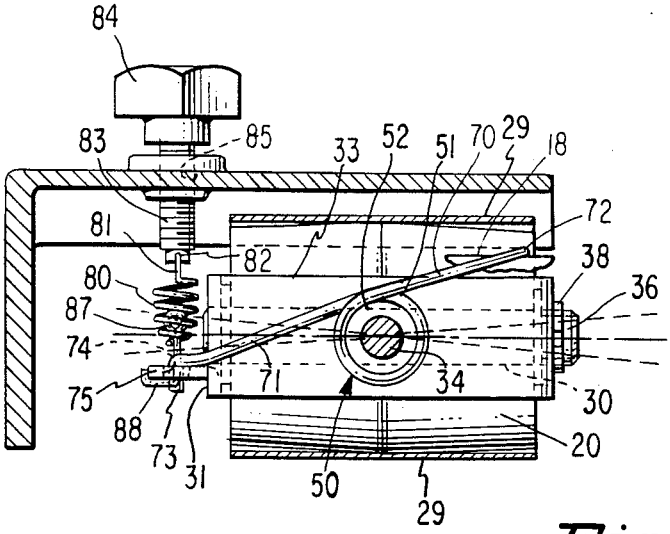
FIG. 3 is a vertical cross sectional view of a portion of the belt sander taken substantially along line 3—3 of FIG. 1.
Figure 4:
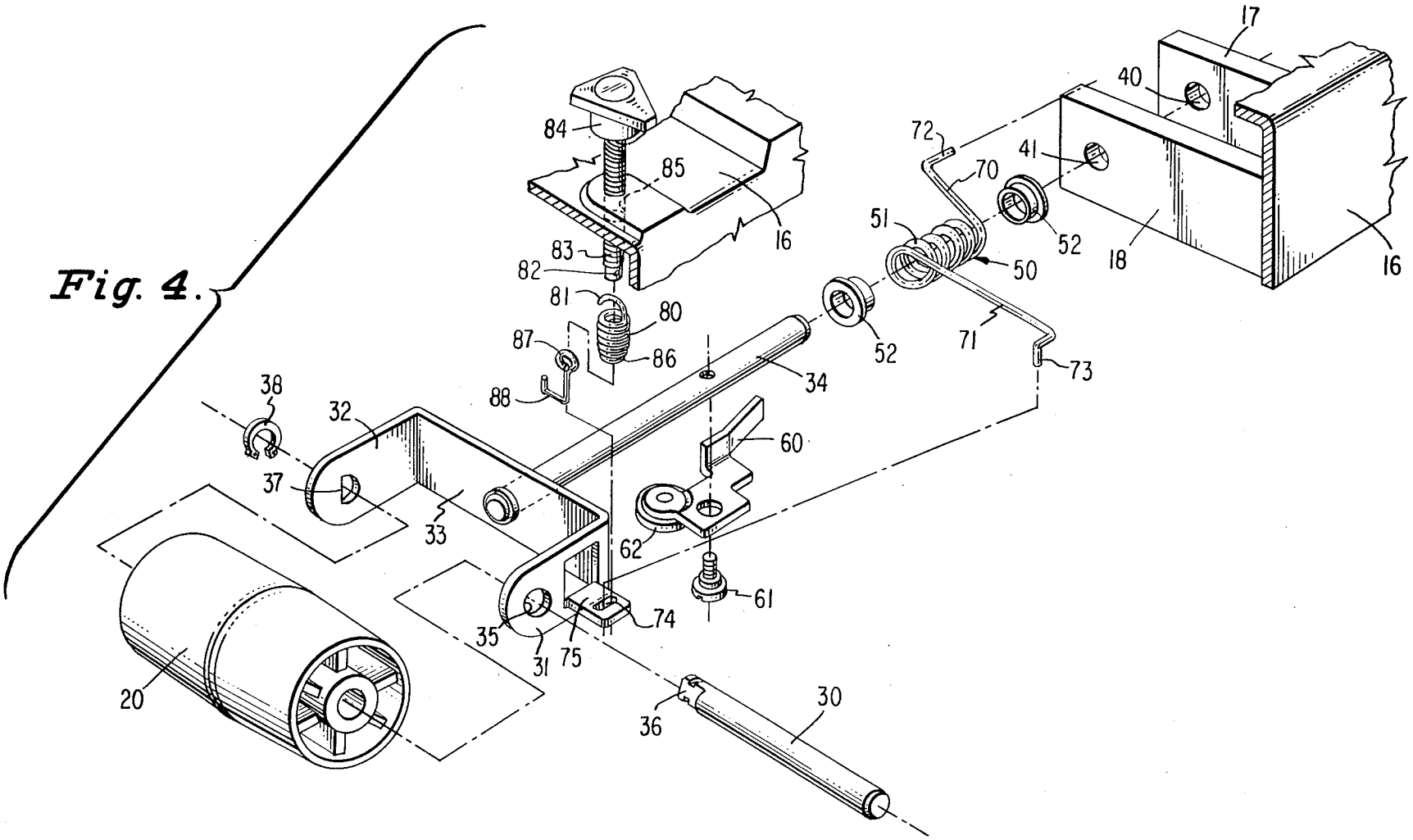
FIG. 4 is an exploded perspective view of the idler roller and associated parts and devices of this invention.

In addition to the coiled portion 51 which serves as a compression spring to apply tension to the sanding belt, the main spring 50 is formed with radially extending arms 70 and 71 one at each extremity of the coiled portion 51. The arm 70 is formed with an offset 72 at the end which in overlying the frame web 18 anchors the spring arm 70 to the sander frame. The end of arm 71 is offset as at 73 and arranged in engagement with an aperture 74 formed in an ear 75 stuck out from the arm 31 of the yoke 33. The angular relation of the main spring arms 70 and 71 is formed such that when the spring arms are engaged with the frame web 18 and yoke ear 75, respectively, as shown in FIGS. 1, 2 and 3. The main spring 50 will apply a torsional force to the yoke 33 about the axis of the shaft 34 in a counterclockwise direction as viewed in FIG. 3.

The torsion applied by the main spring 50 to the yoke 33 is opposed and balanced by a second spring 80 which may be a small coil spring arranged in tension. Preferably, the second spring 80 is formed with a hook 81 at one extremity extending through a transverse aperture 82 in a threaded stud 83 formed with an enlarged head 84 and threadedly engaged in a threaded hole 85 formed in the frame portion 16. The spring 80 is formed at the other extremity with a beehive shape 86 which embraces a coil 87 formed on a spring wire hook 88 thus providing a freely rotatable connection between the spring 80 and the hook 87 which engages the aperture 74 of the yoke ear 75.

Preferably, an initial adjustment of the threaded stud 85 is made balancing the torsion applied in the counterclockwise direction to the yoke by the main spring 50 with that applied on the clockwise direction by the second spring 80 at a value which positions the axes of both the driven and idler rollers 19 and 20 in a common plane. No load test operation of the sander with a sanding belt accommodated on the rollers 19 and 20 and the tension lever disengaged as shown in solid lines in FIGS. 1 and 2 is then observed and adjustment of the stud can be made to cause the sanding belt to track in centered position on the rollers as shown in FIG. 2. Reduction of force exerted by second spring 80 will result in a counterclockwise shift of the idler roller as viewed in FIG. 3 and will influence lateral shift of a sanding belt on the roller 20 to the right in FIG. 3 and vice versa.

With the sanding belt tracking centrally as result of initial manual adjustment, lateral drift of the sanding belt due to external influence will give rise to automatic compensation by the spring arrangement described above acting to restore the belt to a desired central tracking relation on the rollers 19 and 20.

Having set forth the nature of this invention, what is claimed herein is:

1. In a portable electric belt sander having a frame, an electric motor carried in said frame, a driven belt roller journaled on an axis fixed in said frame and having drive connections to said motor, an idler belt roller carried on said frame in spaced relation to said driven belt roller, said rollers being adapted to accommodate thereon an endless sanding belt, a self correcting belt tracking mechanism comprising: a yoke assembly including a cylindrical shaft having a bifurcate yoke fixed at one extremity, means journaling said idler belt roller on an axis extending transversely of said cylindrical shaft in said bifurcate yoke extremity, means slidably journaling said cylindrical shaft in said frame on an axis perpendicular to said driven belt roller axis; spring means arranged to act between said frame and said yoke to tension a sanding belt accommodated on said rollers, and separate spring means acting between said frame and said yoke and arranged each to urge said yoke with said idler roller journaled transversely therein to turn in an opposite direction about the axis of said cylindrical shaft.

2. In a portable electric belt sander, a self correcting belt tracking mechanism as set forth in claim 1 in which said spring means arranged to tension a sanding belt accommodated on said rollers and one of said separate spring means arranged to urge said idler roller to turn is provided by a unitary spring member.

3. In a portable electric belt sander, a self correcting belt tracking mechanism as set forth in claim 2 in which said unitary spring member is formed with a continuously coiled portion arranged on said cylindrical shaft to act in compression between said frame and said yoke to tension a sanding belt accommodated on said rollers, and in which radially extending arms are formed one at each extremity of said coiled portion of said unitary spring member, said radial arms being anchored to said frame and to said yoke, respectively, to act in torsion to urge the axis of said roller to turn.

4. In a portable electric belt sander, a self correcting belt tracking mechanism as set forth in claim 1 which includes operator influenced means for adjusting the spring force exerted by one of said separate spring means acting to urge said yoke with said roller journaled transversely therein to turn about the axis of said cylindrical shaft.

* * * * *